US009168461B1

(12) United States Patent
Chen

(10) Patent No.: US 9,168,461 B1
(45) Date of Patent: Oct. 27, 2015

(54) BOUNCER SWING

(71) Applicant: Samuel Chen, Shanghai (CN)

(72) Inventor: Samuel Chen, Shanghai (CN)

( * ) Notice: Subject to any disclaimer, the term of this patent is extended or adjusted under 35 U.S.C. 154(b) by 0 days.

(21) Appl. No.: 14/313,450

(22) Filed: Jun. 24, 2014

(51) Int. Cl.

| | |
|---|---|
| ***A63G 9/14*** | (2006.01) |
| ***A47D 15/00*** | (2006.01) |
| ***A63G 9/04*** | (2006.01) |
| *A63G 9/00* | (2006.01) |

(52) U.S. Cl.
CPC ..... *A63G 9/14* (2013.01); *A47D 15/006* (2013.01); *A63G 9/04* (2013.01)

(58) Field of Classification Search
CPC ..... A63B 5/00; A63B 5/11; A63B 21/023; A63B 21/0552; A63B 9/00; A63B 9/02; A63B 9/12; A63B 9/14
USPC ..... 472/118, 120–125; 482/27
See application file for complete search history.

(56) References Cited

U.S. PATENT DOCUMENTS

| | | | | |
|---|---|---|---|---|
| 2,169,710 A * | 8/1939 | Schmidt | ..... | 446/322 |
| 3,977,122 A * | 8/1976 | Meyer et al. | ..... | 446/268 |
| 5,545,110 A * | 8/1996 | Hsiang | ..... | 482/27 |
| 5,788,606 A * | 8/1998 | Rich | ..... | 482/27 |
| 6,511,383 B1 * | 1/2003 | Raidt et al. | ..... | 472/135 |

* cited by examiner

*Primary Examiner* — Kien Nguyen
(74) *Attorney, Agent, or Firm* — Clement Cheng

(57) ABSTRACT

A bouncer swing has a suspension frame having legs. Elastic connectors are connected to the suspension frame. A seat harness is attached a lower end of the plurality of elastic connectors at an elastic connector lower connection formed on the seat harness. A trampoline bed is mounted to the suspension frame. The trampoline bed is mounted underneath the seat harness. Springs connect the trampoline bed to the suspension frame. The springs are preferably made of elastic cord. The springs are can be made of exposed elastic tubing. The seat harness may have a seat back that extends from a seat opening of the seat harness. The seat harness has a harness rim that can be contracted for securing a user in place.

12 Claims, 3 Drawing Sheets

BOUNCER SWING

FIELD OF THE INVENTION

The present invention is in the field of swings.

DISCUSSION OF RELATED ART

A variety of different toddler bouncers allow small children to bounce safely while held in a harness.

The traditional child safety swing has typically been a device with an attachment mechanism for securing the device to the chains of a belt seat playground swing and includes a waist strap for encircling the child's body to prevent a small child from tripping forward or backward. This type of traditional child safety swing is shown in U.S. Pat. No. 5,533,934 entitled Child Safety Swing for Playground Swing issued Jul. 9, 1996 to inventor Rene M. Miller, the disclosure of which is incorporated herein by reference.

U.S. Pat. No. 7,175,535 was issued Feb. 13, 2007 to inventor Peter A. Marmentini entitled Portable Playground Swing Seat, the disclosure of which is incorporated herein by reference. The patent describes a portable playground swing seat configured to interface with a playground swing and that includes an open-topped, rigid, cup shaped bucket. The lower portion of the playground swing seat is secured along with the swing chain attachment arms.

Other inventions regarding child safety includes swing harnesses. In U.S. Pat. No. 5,839,965 issued Nov. 24, 1998 to inventor Lora Mullins entitled Child Swing Harness describes an apparatus for converting a conventional swing into a toddler swing by providing a child swing harness that can be quickly and easily placed around a child and attached to a conventional swing, the disclosure of which is incorporated herein by reference.

In U.S. Pat. No. 5,201,693 issued Apr. 13, 1993 to inventor Curtis A. Sparkes entitled Baby Bouncer describes an apparatus with springs which is adapted in use to be suspended from an overhead suspension arrangement, and a harness for holding the baby which is suspended below the spring, the disclosure of which is incorporated herein by reference.

The proposed invention is an improvement from the prior art as it incorporates safety into the bouncer swing.

SUMMARY OF THE INVENTION

A bouncer swing has a suspension frame having legs. Elastic connectors are connected to the suspension frame. A seat harness is attached a lower end of the plurality of elastic connectors at an elastic connector lower connection formed on the seat harness. A trampoline bed is mounted to the suspension frame. The trampoline bed is mounted underneath the seat harness. Springs connect the trampoline bed to the suspension frame. The springs are preferably made of elastic cord. The springs are can be made of exposed elastic tubing. The seat harness may have a seat back that extends from a seat opening of the seat harness. The seat harness has a harness rim that can be contracted for securing a user in place.

The seat harness is connected to the suspension frame by a plurality of elastic connectors, and the elastic connectors can have an elastic connector lower connection that connects to a harness rim of the seat body. The seat harness is mounted to swing on a pivot axis to provide a swinging and bouncing movement for the user.

Figure 1:
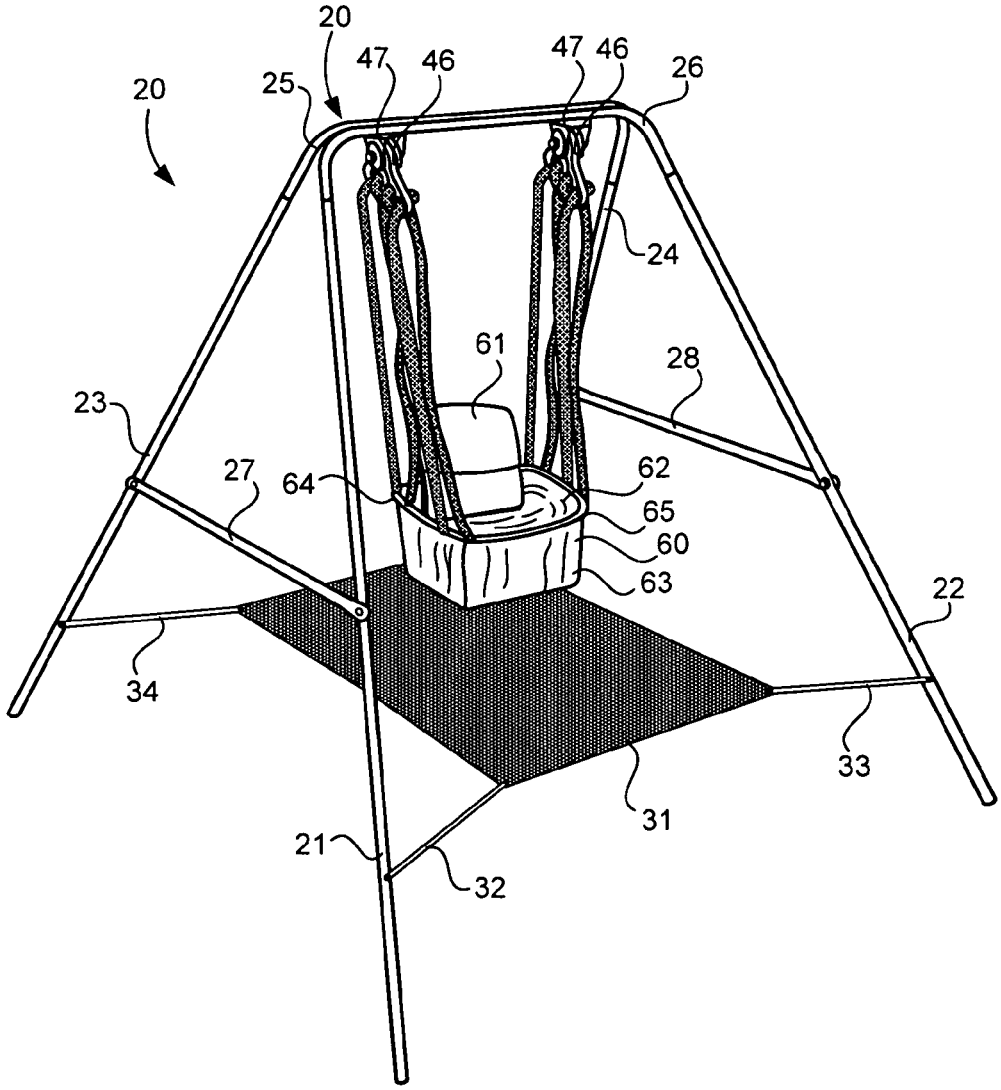
FIG. 1 is a perspective view of the present invention.
Figure 2:
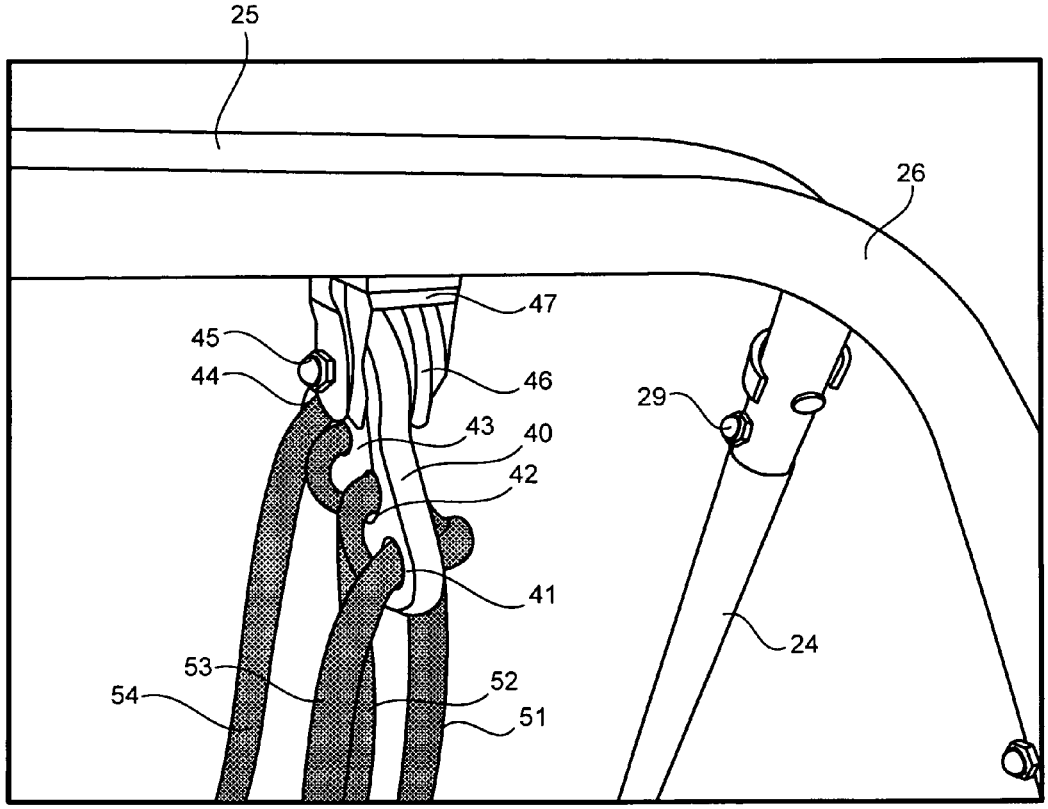
FIG. 2 is a close-up view of the suspension connector.
Figure 3:
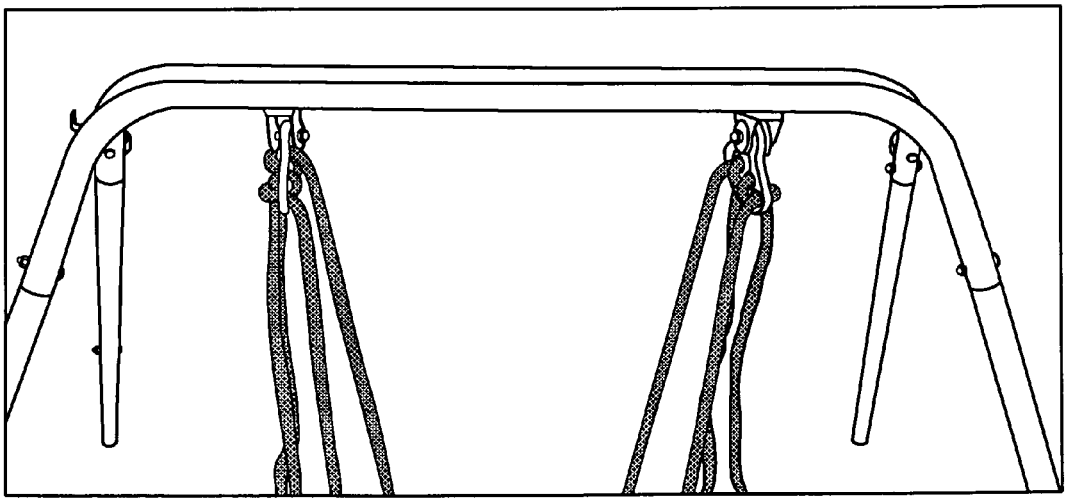
FIG. 3 is a perspective diagram of the elastic connectors.

The following callout list of elements can be a useful guide in referencing the elements of the drawings.

20 Suspension Frame
21 Front Left Leg
22 Front Right Leg
23 Rear Left Leg
24 Rear Right Leg
25 Rear Frame Connector
26 Front Frame Connector
27 Left Horizontal Support
28 Right Horizontal Support
31 Trampoline Bed
32 Left Front Spring
33 Right Front Spring
34 Left Rear Spring
40 Suspension Connector
41 First Elastic Connector
42 Second Elastic Connector
43 Elastic Connector
44 Fourth Elastic Connector
45 Suspension Connector Pivot Bolt
51 First Elastic Connector
52 Second Elastic Connector
53 Third Elastic Connector
54 Fourth Elastic Connector
60 Seat Harness
61 Seat Back
62 Seat Opening
63 Seat Body
64 Elastic Connector Lower Connection
65 Harness Rim

DETAILED DESCRIPTION OF THE PREFERRED EMBODIMENT

The present invention includes a suspension frame 20 having a front left leg 21, a front right leg 22, a rear left leg 23, and a rear right leg 24. A rear frame connector 25 has a connection with a front frame connector 26 such as by bolts or welding so that preferably, the pair of frame connectors provides a total of at least four sockets for the supporting legs. The rear frame connector 25 is bent to provide an angle connection to form sockets for the supporting legs. The legs can be connected to the sockets by bolts such as frame bolts 29. In addition to the frame bolt 29, a leg such as the rear right leg 24 can be attached to the rear frame connector 25 by a socket connection with a leg made to have a smaller diameter to allow fitting inside a portion of the frame connector. The socket connection can also be made with the frame connector being made as a hollow tubular member can also have a smaller diameter that can fit inside the hollow tubular leg. The members of the frame are preferably made of hollow tubular metal to allow ease of shaping ends for providing mechanical connection with other frame members.

The left horizontal support 27 connects between the front left leg and the rear left leg. The right horizontal support 28 connects between the front right leg and the rear right leg. Optionally, the left horizontal support and the right horizontal support can be made foldable so that the suspension frame 20 can be folded to a flat position for shipping or storage. If the horizontal supports are made foldable, preferably the horizontal supports have a hinge at a midsection of the horizontal supports to allow the horizontal supports to fold upward while distal ends of the horizontal support are pivotably connected to the leg frame members. Additionally, a flexible member such as a chain or semirigid cable can be used for the horizontal supports instead of a tubular rigid metal member.

The suspension frame 20 suspends a seat harness 60 over a trampoline bed 31. The trampoline bed 31 can be retained to the suspension frame 20 using a variety of different types of springs. For example, a left front spring 32 can connect a corner of the trampoline bed 31 to the front left leg 21. A right front spring 33 can connect the right front leg 22 to the a corner of the trampoline bed 31. The left rear spring 34 can connect the trampoline bed to the rear left leg 23. Also, a right rear spring can connect the trampoline bed to the right rear leg.

A user can sit in the seat harness 60 and is supported by a seat back 61 that extends from a seat opening 62 of the seat harness 60. The seat harness preferably includes a harness rim 65 that can be contracted for safety belting a child or toddler in place. The seat harness 60 is connected to the suspension frame 20 by a plurality of elastic connectors. The elastic connectors have an elastic connector lower connection 64 that connects to a harness rim 65 of the seat body 63.

The bounce surface is under the seat and has no connection to the seat. The bounce surface connects by springs such as coil springs, leaf springs, an elastic cord such as a bungee cord, or by elastic tubing to the legs of the frame. Springs can be made out of a variety of different material such as plastic, metal, or wood and can have a variety of different shapes. Preferably, the bounce surface is made to be extended generally in a horizontal plane to support legs of a user that extend from leg openings on an underside of the seat body 63. A seat opening 62 allows a user to enter the seat harness 60 so that the user is retained in the seat body 63. The legs of the user extend from leg openings and the user can jump on the trampoline bed 31 while being supported by the elastic connectors.

For improved stability, more than one elastic connector member can be used. For example, the elastic connectors can be formed elastic elongated members such as a bungee cord, or by elastic tubing. A first elastic connector 51, a second elastic connector 52, a third elastic connector 53, and a fourth elastic connector 54 can provide bouncing support for cyclical bouncing by a user. Four elastic connectors can be used on the right side and four elastic connectors can be used on the left side. The user can bounce from the elastic connectors, and then alternatively bounce from the trampoline when the legs become stronger.

The elastic connectors are connected to a suspension connector 40. The suspension connector 40 is connected to the bracket with a bracket base 47 that has a suspension connector bracket 46. The suspension connector 40 is connected to the elastic connectors at elastic connector openings. A first elastic connector opening 41 is located in the front, with a second elastic connector opening 42 behind it. A third elastic connector opening 43 is located behind the second elastic connector opening. Finally, a fourth elastic connector opening 44 is located behind the third elastic connector opening 43. The suspension connector pivot bolt 45 provides a pivot axis so that the suspension connector 40 can rotate relative to the suspension connector bracket 46. The suspension connector 40 is in pivotal mechanical connection with the suspension connector bracket 46. The seat harness 60 can swing on the pivot axis to provide a swinging and bouncing movement for a user. Swinging and bouncing is also combined with the possibility of the user using legs to jump on the trampoline bed 31. The trampoline bed 31 is mounted to the suspension frame 20 below the seat harness 60.

The tension of the elastic connectors is preferably sufficient to keep the elastic connectors straight and not binding with each other. A sheath can at least partially encapsulate a portion of the bundle of elastic connectors to avoid entanglement with the child's limbs or neck.

The present invention can be used in three different ways. The preferred user is a toddler. The toddler can jump on the trampoline by itself while being held in the safety harness. The toddler can also swing on the seat harness and use the seat harness as a normal swing. The toddler can also jump up and down and be supported using the elastic connectors without touching the trampoline, such as if the child lifts up his or her legs. Each of these three different modes can be used simultaneously or not at all. For example, the child can swing and jump on the trampoline, the child can bounce and swing without touching the trampoline, and the child can bounce on the seat harness and jump on the trampoline at the same time. The child can do all three motions simultaneously as well.

A variety of minor modifications to the preferred embodiment can be made without departing from the scope of the claims, such as by adding plastic end caps to some of the rigid tubular metal member ends.

The invention claimed is:

1. A bouncer swing comprising:

a. a suspension frame having legs;

b. a plurality of elastic connectors connected to the suspension frame, namely a first elastic connector, a second elastic connector, a third elastic connector, and a fourth elastic connector;

c. a seat harness attached a lower end of the plurality of elastic connectors at an elastic connector lower connection formed on the seat harness, wherein the first elastic connector, the second elastic connector, the third elastic connector, and the fourth elastic connector are connected to the seat harness;

d. a trampoline bed mounted to the suspension frame, wherein the trampoline bed is mounted underneath the seat harness; and e. springs connecting the trampoline bed to the suspension frame wherein each of said corners is connected to one of said springs, which is in turn connected to the suspension frame such that each corner is biased outward toward the suspension frame.

2. The bouncer swing of claim 1, wherein the springs are made of elastic cord.

3. The bouncer swing of claim 1, wherein the springs are made of elastic tubing.

4. The bouncer swing of claim 1, wherein the seat harness has a seat back that extends from a seat opening of the seat harness.

5. The bouncer swing of claim 1, wherein the seat harness has a harness rim that can be contracted for securing a user in place.

6. The bouncer swing of claim 1, wherein the seat harness is connected to the suspension frame by a plurality of elastic connectors, wherein the elastic connectors have an elastic connector lower connection that connects to a harness rim of the seat body.

7. The bouncer swing of claim 1, wherein the seat harness is mounted to swing on a pivot axis to provide a swinging and bouncing movement for the user.

8. The bouncer swing of claim 7, wherein the springs are made of elastic cord.

9. The bouncer swing of claim 7, wherein the springs are made of elastic tubing.

10. The bouncer swing of claim 7, wherein the seat harness has a seat back that extends from a seat opening of the seat harness.

11. The bouncer swing of claim 7, wherein the seat harness has a harness rim that can be contracted for securing a user in place.

12. The bouncer swing of claim 7, wherein the seat harness is connected to the suspension frame by a plurality of elastic connectors, wherein the elastic connectors have an elastic connector lower connection that connects to a harness rim of the seat body.

* * * * *